US006364265B1

(12) United States Patent
Milligan et al.

(10) Patent No.: US 6,364,265 B1
(45) Date of Patent: Apr. 2, 2002

(54) EXTENDABLE SWIVEL MOUNTING BRACKET

(75) Inventors: Charles A. Milligan, Seal Beach; Avi Bilu, Diamond Bar, both of CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 0 days.

(21) Appl. No.: 09/327,208

(22) Filed: Jun. 7, 1999

(51) Int. Cl.[7] ..... A47F 5/00

(52) U.S. Cl. ..... 248/298.1; 108/143; 248/281.11; 248/285.1

(58) Field of Search ..... 248/298.1, 281.11, 248/286.1, 292.14, 284.1, 278.1, 441.1, 442.2, 223.41, 918, 323, 285.1; 108/137, 138, 140, 143; 384/42, 40

(56) References Cited

U.S. PATENT DOCUMENTS

| | | | | |
|---|---|---|---|---|
| 669,907 A | | 3/1901 | Wernicke et al. | |
| 3,096,962 A | | 7/1963 | Meijs | 248/276 |
| 3,584,822 A | | 6/1971 | Oram | 248/160 |
| 4,254,928 A | | 3/1981 | Huempfner et al. | 248/422 |
| 4,580,754 A | | 4/1986 | Hughes | 248/285 |
| 4,987,835 A | | 1/1991 | Schwartz et al. | 108/144 |
| 5,083,514 A | | 1/1992 | Schwartz et al. | 108/144 |
| 5,402,737 A | | 4/1995 | Kanazawa | 108/147 |
| 5,452,876 A | * | 9/1995 | Hatcher | 248/441.1 |
| 5,626,323 A | * | 5/1997 | Lechman et al. | 248/286.1 |
| 5,681,116 A | * | 10/1997 | Lin | 384/42 |
| 5,871,188 A | * | 2/1999 | Lyle | 248/223.41 |
| 5,924,664 A | * | 7/1999 | Mileos et al. | 248/281.11 |
| 5,938,340 A | * | 8/1999 | Brodersen | 384/40 |
| 6,021,985 A | * | 2/2000 | Hahn | 248/286.1 |
| 6,027,090 A | * | 2/2000 | Liu | 248/281.11 |

* cited by examiner

*Primary Examiner*—Ramon O. Ramirez
*Assistant Examiner*—Tan Le
(74) *Attorney, Agent, or Firm*—Christie, Parker & Hale, LLP

(57) ABSTRACT

A swivel mounting bracket couples a heavy and cumbersome object to a casing attached to an undersurface. Slide members can attach the mounting bracket to the casing and allow the mounting bracket to be extendable. The mounting bracket comprises a support surface, and a bridge integral with the support surface. A rotatable plate slides and releasably locks in between the support surface and the bridge. The plate attaches to the object to be mounted, and allows the object to rotate with respect to the desk.

40 Claims, 19 Drawing Sheets

EXTENDABLE SWIVEL MOUNTING BRACKET

BACKGROUND

This invention relates generally to mounting brackets, and more particularly to a rotatable mounting bracket for mounting items to the underside of a desktop or the like.

The extendable mounting of objects under desktops, tables, and the like is often desirable. This extendable mounting allows the object to be under the desktop when not in use, and easily accessible when necessary. Accordingly, such mounting permits both easy access to the objects when desired, as well as convenient storage of the items when not in use.

Both the mounting apparatus and the objects, such as keyboard support arms and CPU unit holders, are often heavy and cumbersome. Moreover, the mounting apparatus is often coupled first with the object to become a single piece of equipment. Then this relatively large and heavy piece of equipment is mounted to the undersurface. Accordingly, when installing this mounting apparatus, there is often difficulty in holding it in place and using tools while mounting it to the underside of the desk. The apparatus is usually quite heavy, which alone can make mounting difficult. In addition to the relatively heavy weight of the apparatus, the apparatus is often cumbersome in that there may be portions that move undesirably during installation, therefore increasing the difficulty of installation. Further, it is often difficult for the installer to be in a comfortable position and still have the mounting location in sight. For these reasons it is desirable to have a mounting bracket that can first be mounted to the undersurface, and then the heavy object couples to the mounting bracket.

Further, heavy or cumbersome objects that can pivot and swivel are often desirable for use in desks. Having objects that can swivel permits both easy access and comfortable use of the desk and/or computer. The user, for example, might place the computer monitor in the corner of a desk unit. This configuration permits the user to sit close to the desk while still being spaced a comfortable distance from the computer monitor screen. However, when the monitor is placed in this configuration and the typical keyboard support arm is used, the user must have the torso face toward the keyboard support arm, but the head is turned to an uncomfortable position in order to view the computer monitor screen. Having a keyboard that can swivel allows the user's torso to be lined up with the computer monitor.

It is additionally desirable for objects to be extendable from the underside of a desk. For example, having an object mounted to a slide or a folding arm provides for both easy access and storage. Advantageously, the heavy or cumbersome object can be easily pulled out rather than lifted or dragged to a usable position. Also, the use of slides allows for the objects to be maintained in a horizontal position regardless of how far the object is withdrawn from the desk.

It is also desirable to have electrical attachments of items such as CPU units both easily accessible to the user and out of sight when no adjustments are needed. The back side of a CPU for example, has multiple outlets. There is generally a cord to the monitor, the keyboard, the mouse, the Internet, to a printer and/or network system, and a power cord. If one of these cords needs to be replaced, switched, or comes loose, there is difficulty in reaching these cords behind the CPU. The user must either crawl under the desk to adjust the cords for a free standing CPU, lean over a desk for a desktop CPU, or drag the CPU to a position where the backside of the CPU can be more easily viewed and adjusted. Because the cords and backside of the CPU are unsightly, the user prefers to have the backside of the CPU out of view unless there is a need to adjust the unit or cords. It is therefore desirable to have the backside of the CPU unit easily accessible.

SUMMARY OF THE INVENTION

The present invention therefore provides a small, light and easily installable mounting bracket that allows heavy and cumbersome objects to be mounted to an undersurface, and to do so in a rotatable and/or extendable manner.

This is achieved by a swivel mounting bracket. The mounting bracket has a support surface with an incurvate opening along one side. The support surface prevents motion, in a first direction (generally downwards), of a rotatable plate that is coupled to the heavy and cumbersome object. A holding surface is also provided to restrict motion of the plate in a direction opposite the first direction (generally upwards). In one embodiment, the holding surface has a bridge, coupled to the support surface, that forms a band.

Any heavy and cumbersome object that incorporates the rotatable plate can be easily attached to the mounting bracket without the use of tools. For a greater benefit, at least one slide couples the support surface to a casing which is attached to the undersurface. The rotatable plate allows the object to swivel, while the slide enables the object to extend out from the undersurface.

In another embodiment, a means is provided for preventing motion of the plate in a direction perpendicular to the first direction. The means used to releasably lock the plate between the support surface and the holding surface includes at least one of a locking lever, a lock tab, a knob, and a twist-lock wedge.

Another object of the present invention is to be able to slide equipment, such as a CPU unit or any other unit desired, out from a stored position to an open position and swivel the equipment around to an adjusting position.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
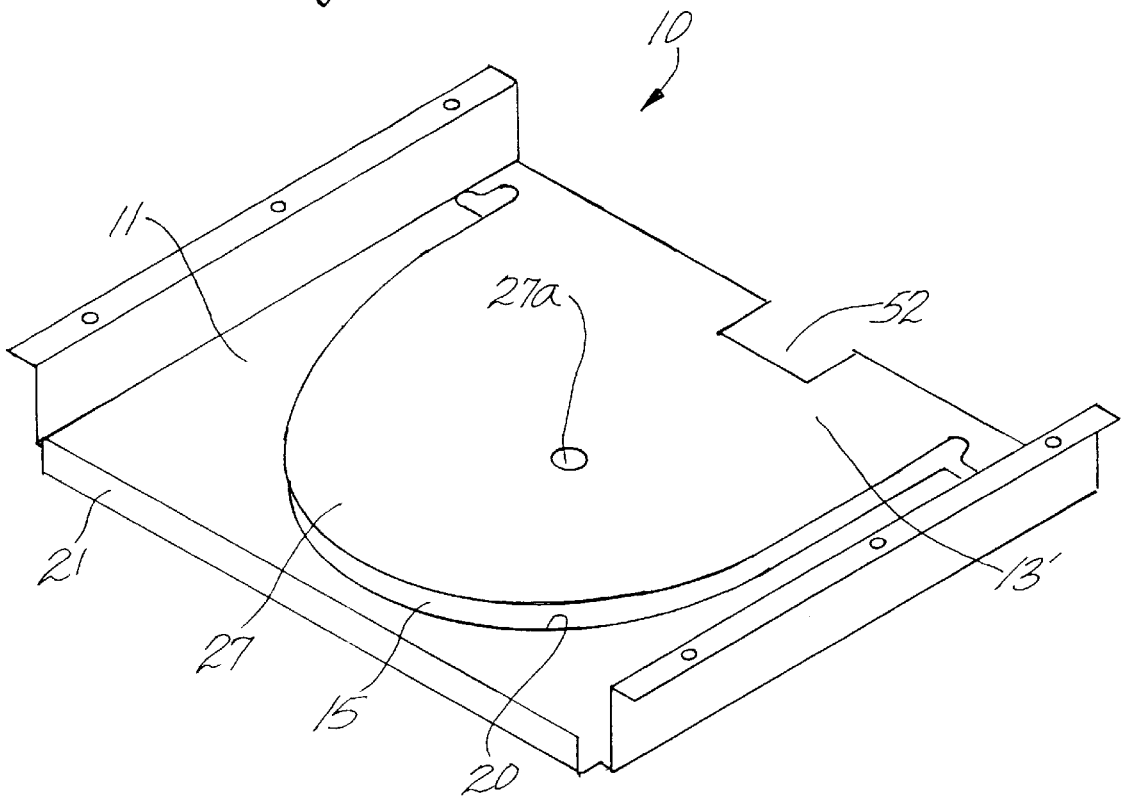
FIG. 1 is a perspective view of a swivel mounting bracket of the present invention.

FIG. 1 illustrates a perspective view of a swivel mounting bracket 10 of the present invention. A top of the bracket 10 is adapted to be mounted directly to the underside of a desktop or the like. The features, functions, and alternatives of the mounting bracket 10 are more fully discussed in the following embodiments.

Figure 2:
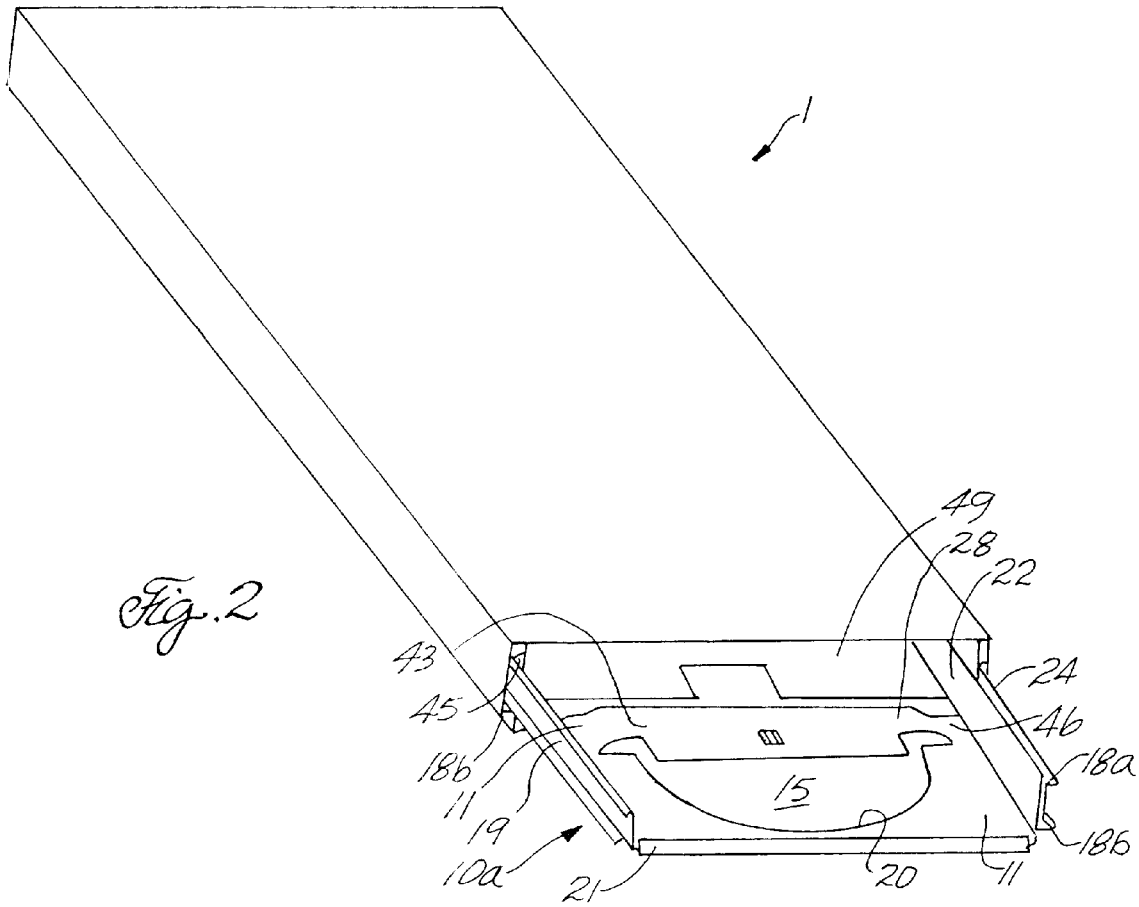
FIG. 2 is a perspective back view of an extendable swivel mounting bracket and a casing according to a first embodiment of the present invention.

FIG. 2 illustrates a perspective view of a mounting bracket casing 1 and a swivel mounting bracket 10*a* of the first embodiment of the present invention. The casing 1 has a substantially flat elongated rectangular top. The top is adapted to be mounted to the underside of a desktop or the like. The embodiment of FIG. 2 has an additional advantage over FIG. 1 in that the swivel mounting bracket 10*a* is capable of being extendably mounted. Two parallel opposing sides descend from opposing margins of the elongated length of the top of the casing. The mounting bracket 10*a* is extendably mounted to the two sides by, in the embodiment of FIG. 2, slides. Thus, the mounting bracket may be placed in a retracted position substantially within the casing, or an extended position toward the user. Depending on the application, the forward edge of the inner slide member may extend only to the front of the casing. In other applications, the inner slide member may extend over the forward position of the outer slide members.

The mounting bracket includes a substantially flat support surface 11. The support surface 11 is somewhat rectangular in shape, with a width allowing for insertion between the two parallel opposing sides of the casing. Along one edge of the width of the support surface 11 are ends 46 of a large semi-circular opening 15 in the support surface 11, which provides the support surface a largely U-shaped configuration.

A bridge 13 in a plane parallel to a plane defined by the support surface 11 joins the ends of the semi-circular opening. The bridge, in the embodiment described, is attached by attachment legs 28 to the ends 46 at inner surfaces 20 of the U-shape. Alternatively, the attachment legs 28 attach the bridge directly to two opposing side walls 22 that extend along the length of the margins of the width of the support surface 11. The attachment legs, when viewing the support surface as defining a horizontal plane, rise vertically from the support surface 11.

Figure 5:
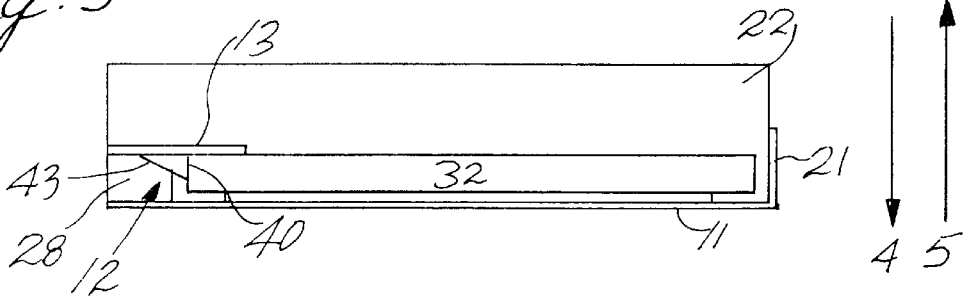
FIG. 5 is a cross-sectional view of a first lock tab on a bridge according to the first embodiment.

Thus, when the support surface is disposed in a horizontal plane, the support surface is adapted to support a plate 32 (shown in FIG. 5) and the bridge is adapted to maintain the plate in position on the support surface. Thus, and as in conformance with FIG. 8, the support surface restricts movement of the plate in a first direction 4 (shown in FIG. 5) and the holding surface restricts movement in an opposite direction 5 (shown in FIG. 5). Moreover, assuming the plate has a width less than the distance between the attachment legs, one may slide the plate into position, namely into a slidable recess located between the support surface and the bridge. In addition the use of a bridge provides some advantages as compared to using a top plate that encloses the slidable recess. An enclosed recess could allow dust and foreign objects to accumulate therein, while the bridge allows the forward end of the mounting bracket to remain open, allowing ejectment of dust and foreign objects. Thus, movement of the plate into the position between the support surface and the bridge is not subject to obstruction by dust and foreign objects lodged in the slidable recess.

Figure 4A:
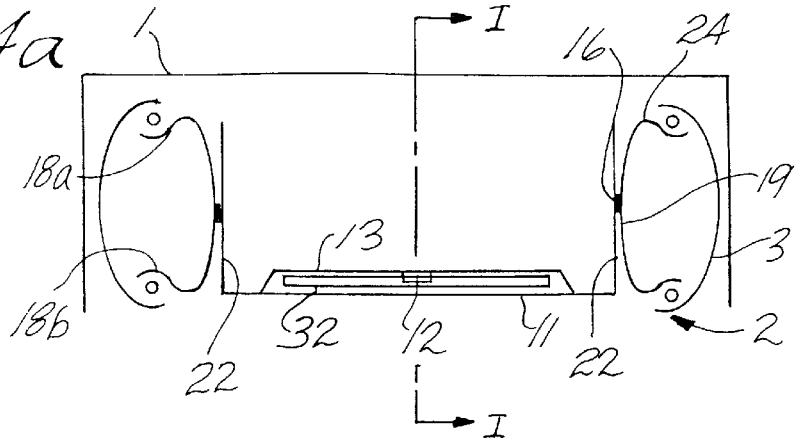
FIG. 4*a* is a back view of the extendable swivel mounting bracket of FIG. 3.
Figure 4B:
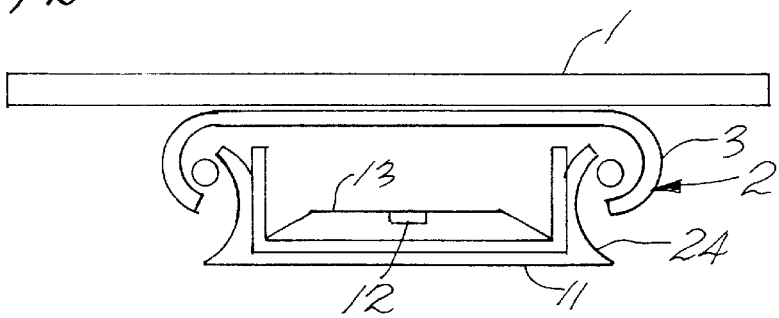
FIG. 4*b* is a back view of the extendable swivel mounting bracket of FIG. 3 with a single slide.

The opposing side walls 22 are adapted to interlink with the opposing sides of the casing 1. In the embodiment illustrated in FIG. 4*a*, which illustrates a back view, i.e. a rear view, of a device, this interlink is accomplished using telescopic slides 2. Telescopic slides, and other types of slides that also may be used in the present invention, are well known in the art. The telescopic slides are comprised of two member slides formed of webs having bearing raceways extending along their lengthwise margins. Slides with additional members may also be used. Alternatively, as shown in FIG. 4*b*, which illustrates a back view, i.e. a rear view, of a further device, a single slide member may be used to couple the mounting bracket directly to the undersurface.

As illustrated, outer slide members 3 are affixed to each of the opposing sides of the casing 1, while inner slide members 24 are affixed to each of the opposing side walls 22 of the mounting bracket. Optionally, rivets 16 are used to make this connection. However, other means can be used to couple the support surface and the inner slide members, such as welding or using a bayonet and pocket combination. The bayonet and pocket combination includes at least one bayonet that is punched out of the web of the slide member. The bayonet therefore forms a tab parallel to the web of the slide member, and in the embodiment described has a free end at its lower edge. Similarly, a pocket is formed in the side of the casing, with the pocket dimensioned so as to receive the bayonet and thereby support the slide.

The inner slide members 24 nest within and interlink with the bearing raceways of the outer slide members 3. The mounting bracket is thereby allowed to be retractably extendable from the casing. In particular, as the casing is generally mounted to the underside of a desktop or the like, the mounting bracket is extendable using the slides from a retracted stowed position under a desktop to an extended working position away from the desktop.

Figure 3:
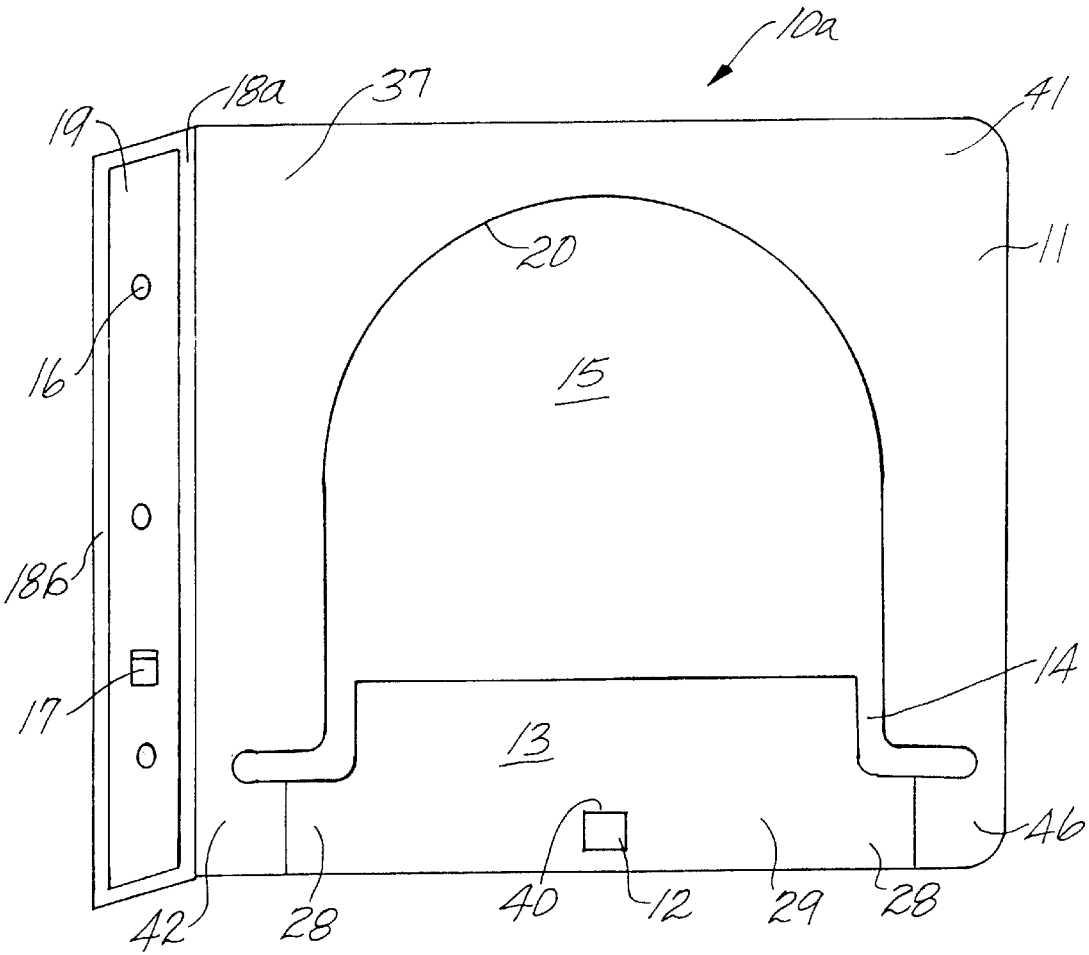
FIG. 3 is a bottom view of an extendable swivel mounting bracket of FIG. 2.

FIG. 3 illustrates a bottom view of the mounting bracket of FIG. 2, including the support surface 11, the bridge 13, and the attachment legs 28. Also shown is a first lock tab 12 on an underside 29 of the bridge 13. The first lock tab releasably locks the plate 32 (shown in FIG. 5) into the mounting bracket by providing an edge surface 40. Movement of the plate is restricted by the first lock tab 12, in conjunction with the support surface 11 which supports the plate, the inner surface 20 which stops forward movement, and the bridge which holds the plate to the support surface.

The first lock tab is punched out from the underside (or bottom surface) of the bridge toward the support surface. As viewed in FIG. 5, the first lock tab has an edge surface 40 substantially perpendicular to the bottom surface of the bridge, and therefore also perpendicular to the support surface. A ramp 43 of the first lock tab descends from the underside of the bridge to an end of the edge surface. The plate is thereby allowed to slide under and along the ramp until an edge of the plate is against the edge surface of the first lock tab in a releasably locked position.

FIG. 3 also illustrates a tab punched into the web of the inner slide member. This tab is a recycling stop 17 used to correctly position, i.e., to recycle the position, of a bearing retainer. Bearing retainers are often used with slides to hold the bearings coupling the slide members. If the bearing retainer becomes mispositioned, travel of the drawer slides may be affected.

In the embodiment described and shown in FIG. 3, the radius of the circular cross-section of the central circular portion of the plate is approximately 3½ inches and corresponds in dimension to the inner surface 20 of the U-shape. This relatively large diameter increases the stability of the object when the object is swiveled with respect to the mounting bracket 10*a*.

In alternative embodiments, the shape of the plate is not circular. For example, in one alternative embodiment the plate is rectangular in shape (not shown). When the rectangular plate is fully inserted into the mounting bracket 10*a*, the rectangular plate snugly fits along the length of a front wall 21 (shown in FIG. 2), the side walls 22, and against the first lock tab 12. The rectangular plate is coupled to a cylindrical or circular portion (also not shown) that is coupled to the object and rotate within the inner surface of U-shape with respect to the rectangular plate. Alternatively, the rectangular plate has dimensions insufficient to contact the first wall, side walls, or lock tab, and is therefore capable of freely rotating.

Figure 6:
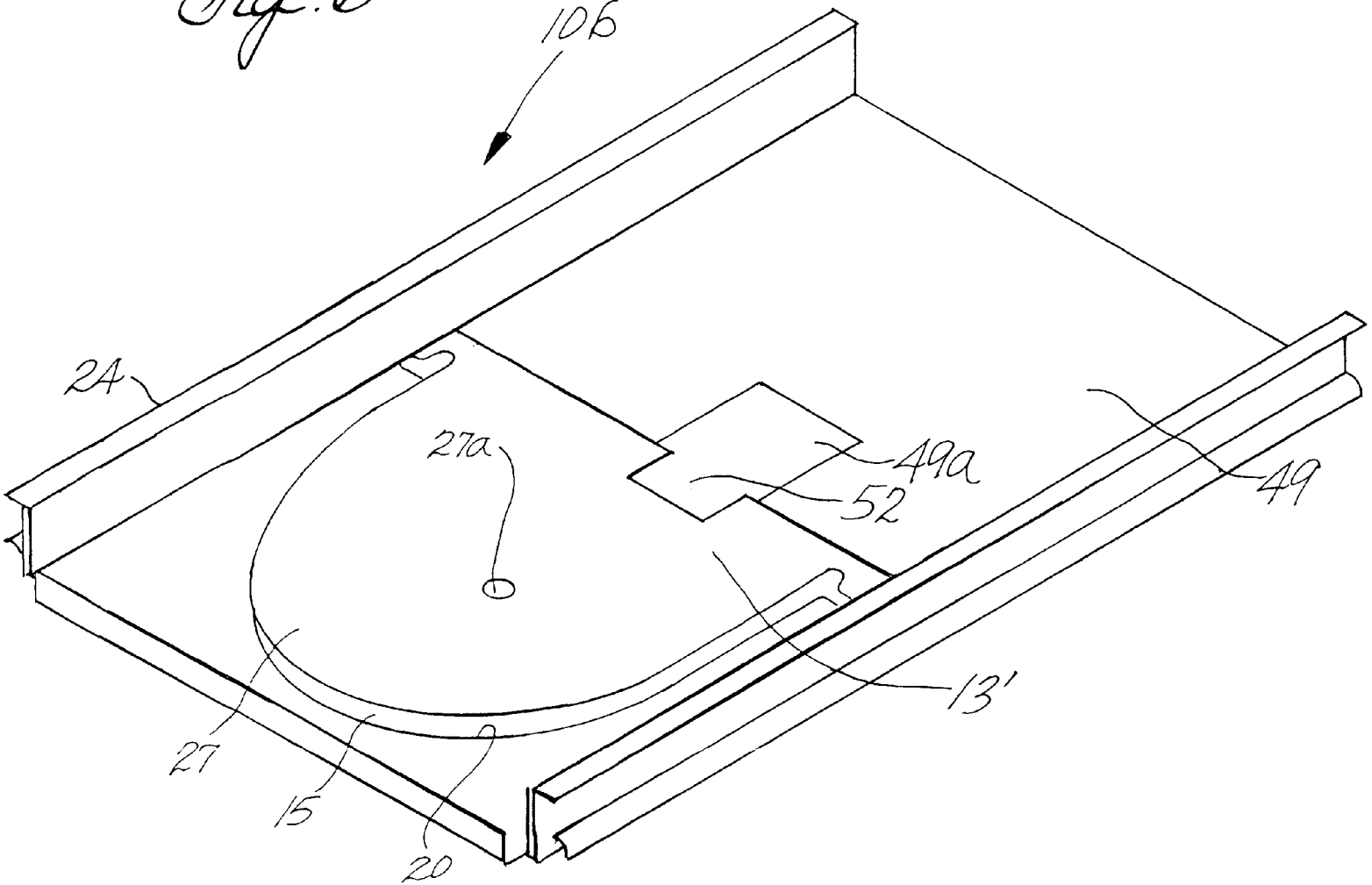
FIG. 6 is a view of the extendable swivel mounting bracket and the back plate.
Figure 7:
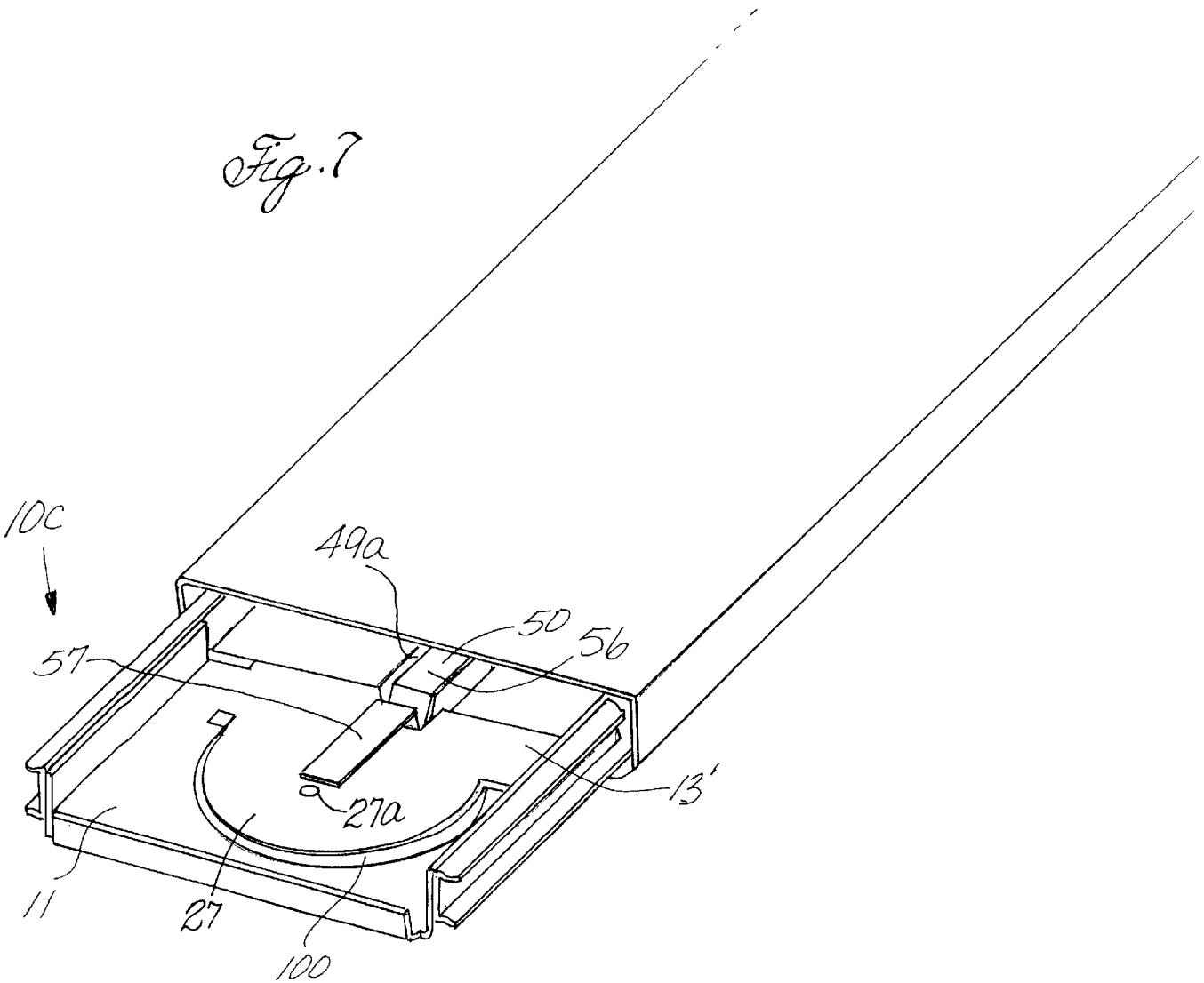
FIG. 7 is a perspective view of a casing and an extendable swivel mounting bracket having a locking lever according to a second embodiment of the present invention.
Figure 8:
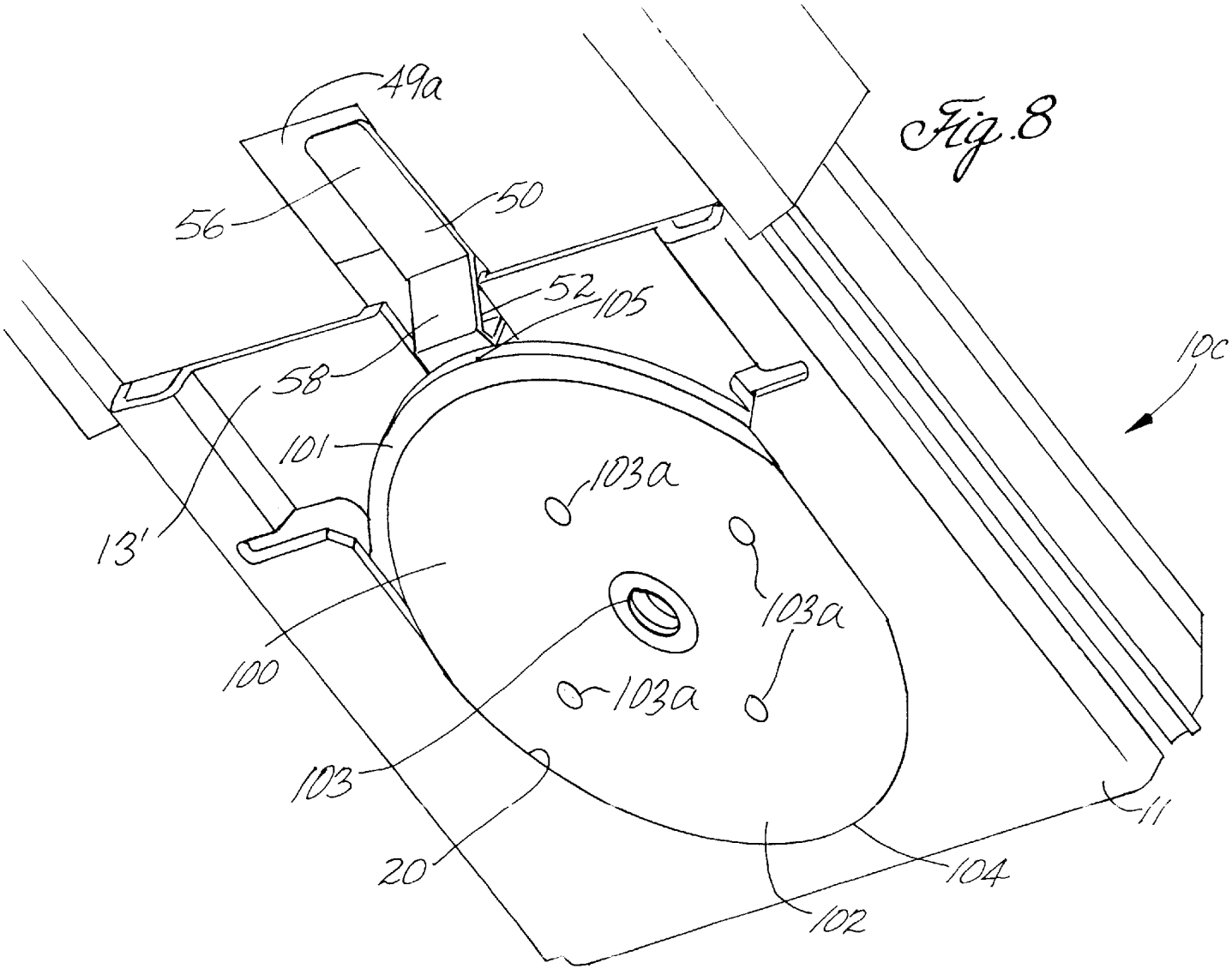
FIG. 8 is a perspective bottom view of an extendable swivel mounting bracket and a casing of FIG. 7.

FIG. 6 illustrates an alternative extendable swivel mounting bracket 10*b* of the present invention which is similar to the bracket of FIG. 2. The bracket of FIG. 6, however, has a bridge 13' with a cut out section 52, but no lock tab. Another cut out section 49*a* of a back plate 49 of the mounting bracket is further shown. When the mounting bracket coupled to the heavy object is pulled forward in the casing, the back plate 49 alleviates the pressure placed on the slide members from the load of the cantilevered heavy object. The back plate 49 acts with the mounting bracket to distribute the force and minimize the pressure along the slide members. The cut out sections 52, 49*a* are adapted to receive a locking lever 50 more fully discussed below with respect to FIGS. 6 and 7. Additionally, an extending member 27 with a central hole 27*a* is included. The extending member extends from the bridge over the aperture 15 in the support surface. The shape of the extending member corresponds to the shape of the inner surface 20. A connecting means not shown) may be optionally placed through the hole 27*a* of the extending member to connect the bridge to a circular disk plate 100 (See FIG. 7) or to connect to the heavy object itself FIG. 8 illustrates an underside of the disk plate 100 mounted in position. A lower disk 102 of the disk plate forms a flat central circular portion extending close to the circumference of the plate 100. Within the central circular portion are four mounting holes 103*a*, spaced equidistant from both each other and a central hole or aperture 103. These mounting holes are adaptable for an object to be mounted to and supported by the plate 100, thereby allowing the plate and the object to rotate with respect to the mounting bracket 10*c*. Thus, in one embodiment the mounting holes receive screws which attach to the object. In alternative embodiments, the object is welded or riveted to the plate. Surrounding the central circular portion, and forming the outermost edge of the plate, is a rim 101. The rim 101 is slightly elevated with respect to the central circular portion of the lower disk 102, thereby providing the plate a platter-like shape.

The lower disk of the plate has a circular shape, but can alternatively be semi-circular or any other shape so long as the plate is capable of pivoting an object that is mounted to and supported by the plate. For example, when the user rotates a computer keyboard support arm, the lower disk coupled with the keyboard support arm rotates with respect to the mounting bracket so that the user may position the keyboard support arm at any desired angle with respect to the desk.

The disk plate 100 releasably locks into the mounting bracket by sliding under the bridge 13', and above the support surface 11. The vertical movement of the disk plate is thus restricted by the mounting bracket 10*c*, as shown in FIGS. 7 and 8. The disk plate slides until a front side 104 of the lower disk 102 reaches the inner surface 20. The plate, including the rim 101, has a radius larger than the radius of the inner surface 20 of the U-shape. This allows the plate to be supported by the support surface 11 at the rim 101 while the lower disk 102 rotates along the inner surface.

The embodiment illustrated in FIG. 8 does not require a lock tab to restrict horizontal movement of the plate, such as described with respect to the embodiment of FIG. 2. Instead, the embodiment of FIG. 8 includes a locking lever 50. The locking lever has a fixed end 57 (FIG. 7) coupled to the bridge 13'. Approximate a free end 56 of the locking lever is a bend 58. The free end is adopted to move within the cut out section 49*a*. The bend is substantially V-shaped. The bend is received by the cut out section 52 and extends into the travel path of the plate. Accordingly, the bend restricts horizontal motion of a back side 105 (FIG. 8) of the disk plate, thereby holding the disk plate in the mounting bracket 10*c*.

To remove the disk plate 100 from a horizontal position on the support surface, the bend 58 of the locking lever 50 moves up in the direction of the bridge 13'. This can be done by pulling the free end 56 of the lever 50 to an upward and forward position which, in turn, retracts the bend 58 to a height level with the bridge. With the bend so positioned, the bend does not restrict horizontal motion of the disk, and therefore does not block the disk from sliding out from between the support surface and the bridge.

Figure 9:
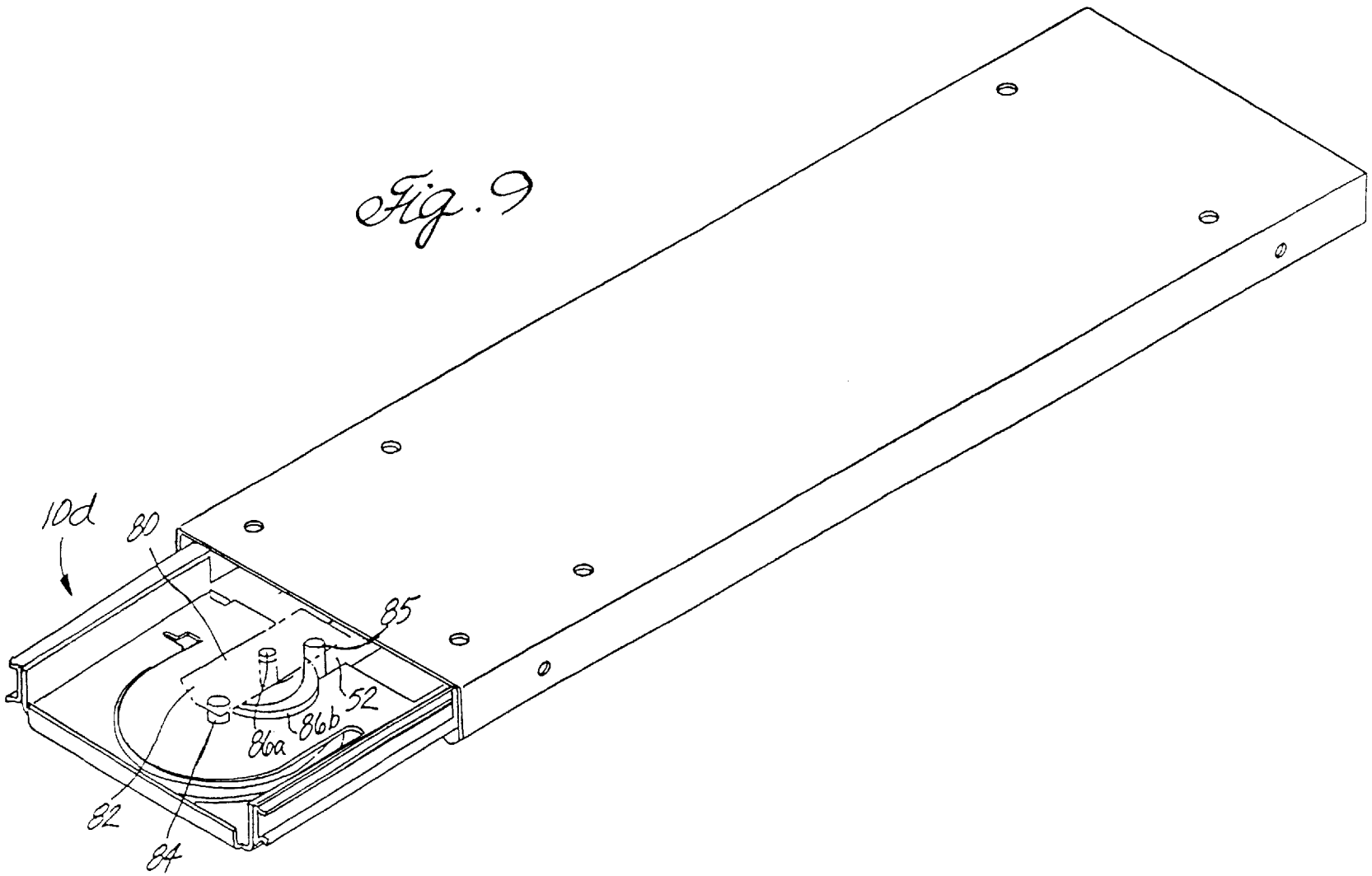
FIG. 9 is a perspective view of an extendable swivel mounting bracket and a casing according to a third embodiment of the present invention.
Figure 10:
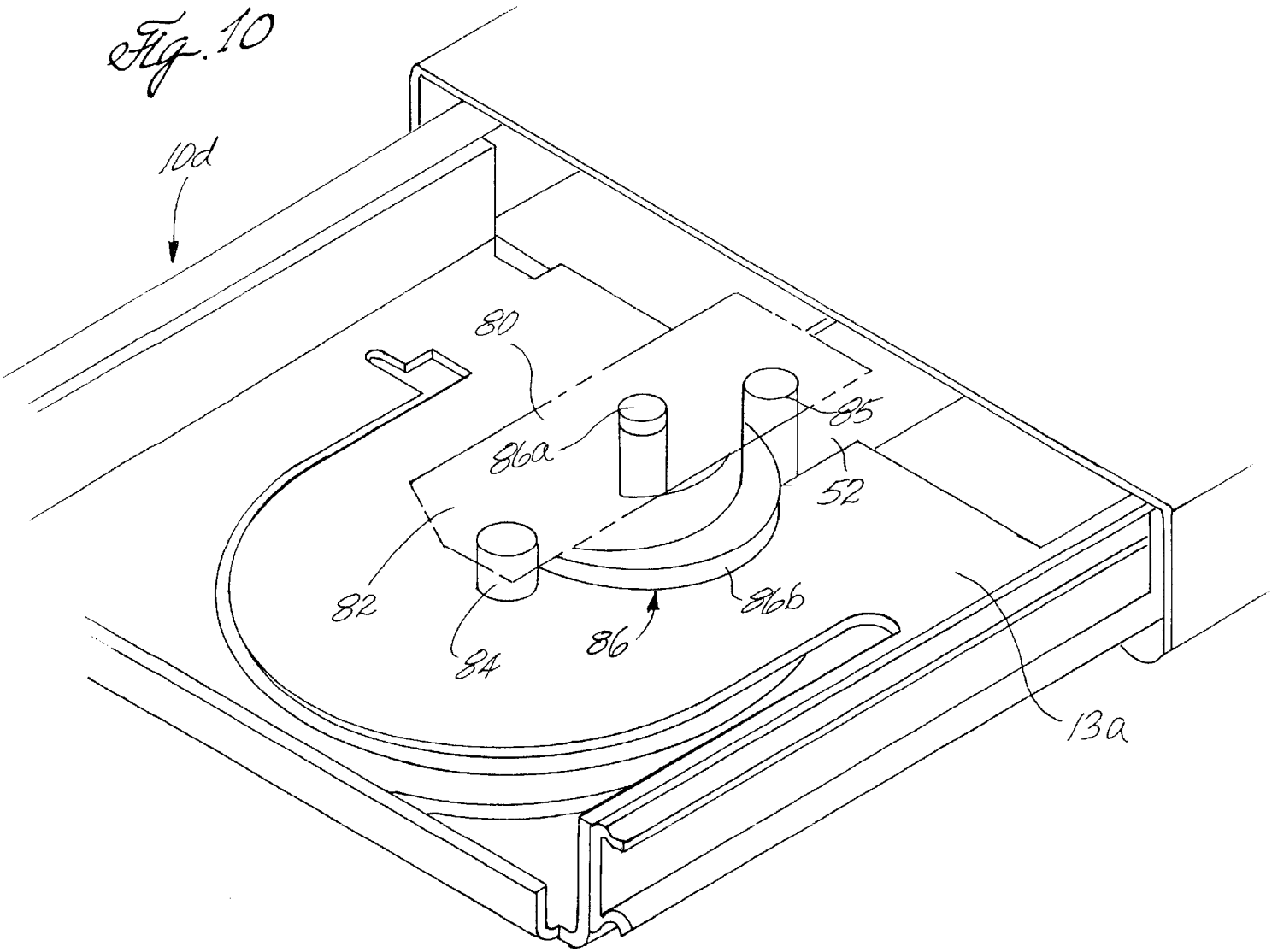
FIG. 10 is a view of the extendable swivel mounting bracket of FIG. 9.

FIG. 9 illustrates an alternative extendable swivel mounting bracket 10*d* of the present invention. The mounting bracket of FIG. 9 is similar to the mounting bracket of FIG. 8, but incorporates a twist-lock wedge 80.

The twist lock wedge includes a handle 82 mounted to a notched base 86 which is attached to the bridge. The base includes a raised circular rim 86*b* with notches forward and aft (not shown). The handle is mounted by a pin 86*a* to a central area of the base surrounded by the rim. The handle is substantially rectangular, as well as wedge shaped in that it has a wider top than bottom. In turn, the notches in the base are adapted to receive portions of the handle. Thus, when the handle is positioned parallel to the motion of travel of the slides, the handle sits recessed in the notched portions of the base. When the handle is positioned perpendicular to the access of travel of the slides, however, the handle rests on the rim in a raised position.

Extending downward from bottom ends of the handle are a first pin 84 and a second pin 85. The base is coupled to the bridge such that when the handle is in the recessed, or parallel position, the first pin is located in a hole 103 of the plate, and the second pin is received by the cutout section 52. The first and second pins thereby hold the plate between the support surface and the bridge. When the handle is lifted, however, the pins are moved out of the plane of the plate and no longer impede movement of the plate. Conveniently, the height of the unnotched portions of the base plate is sufficient to allow the pins to clear the bridge so as to allow the handle to be moved to the raised, or perpendicular, position with the pins resting on the bridge.

The disk plate 100 may be secured into the mounting bracket 10 upon twisting the center portion in a second direction opposite the first direction to the locked position. The wedge and the rotatable center portion translates vertically toward the bridge moving along the threads of the center pin, thereby allowing the central hole to receive the first pin, and the second pin to push against the backside of the disk plate. If the disk plate is in the mounting bracket 10*d* when the pins recess, the disk plate will be secured in place.

Figure 11:
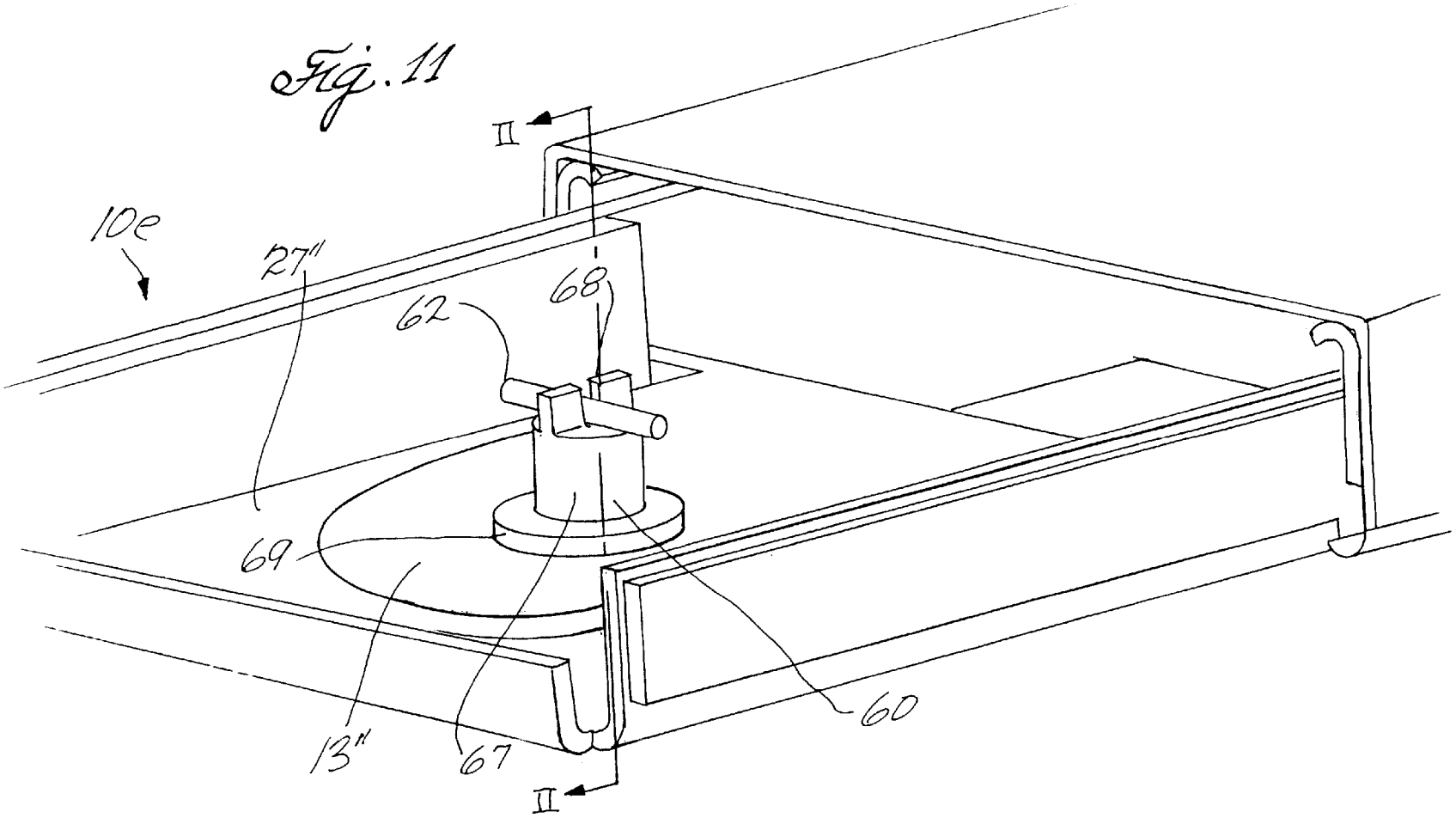
FIG. 11 is a perspective view of an extendable swivel mounting bracket and a casing according to a fourth embodiment of the present invention.

FIG. 11 illustrates another embodiment of an extendable swivel mounting bracket 10*e* which is similar to the previous embodiments except for the manner in which the disk plate is secured in the mounting bracket. In this embodiment, a knob 60 is used to releasably lock and to restrict the horizontal motion of the disk plate.

The knob of FIG. 11 has a discoidal bottom 69 which fixedly attaches to a bridge 13". A central part 67 of the knob 60 is optionally integrally coupled with the discoidal bottom 69 on one end and with two extensions 68 on the other end. The extensions 68 are spaced apart from each other and extend from the central part 67 in a direction away from the disk plate (not shown).

Figure 12:
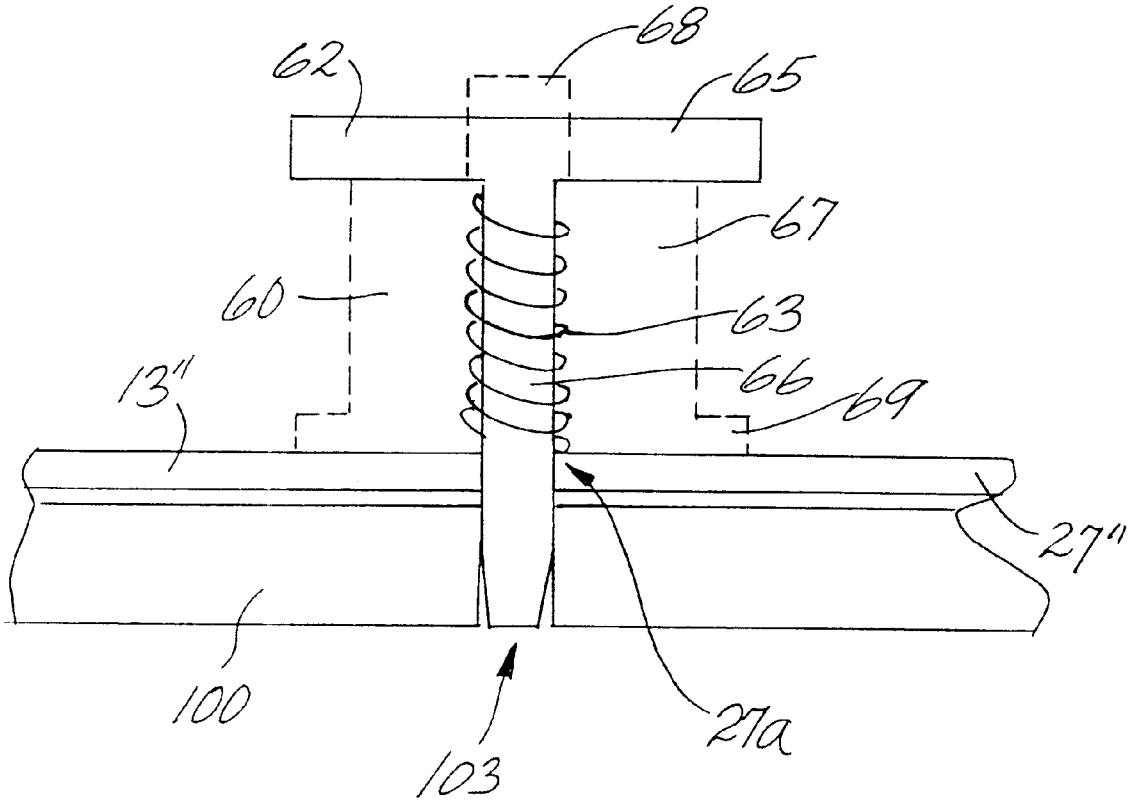
FIG. 12 is a side view along the line II—II of FIG. 11 of the plunger and spring with the knob of FIG. 11 shown in broken line.
Figure 13:
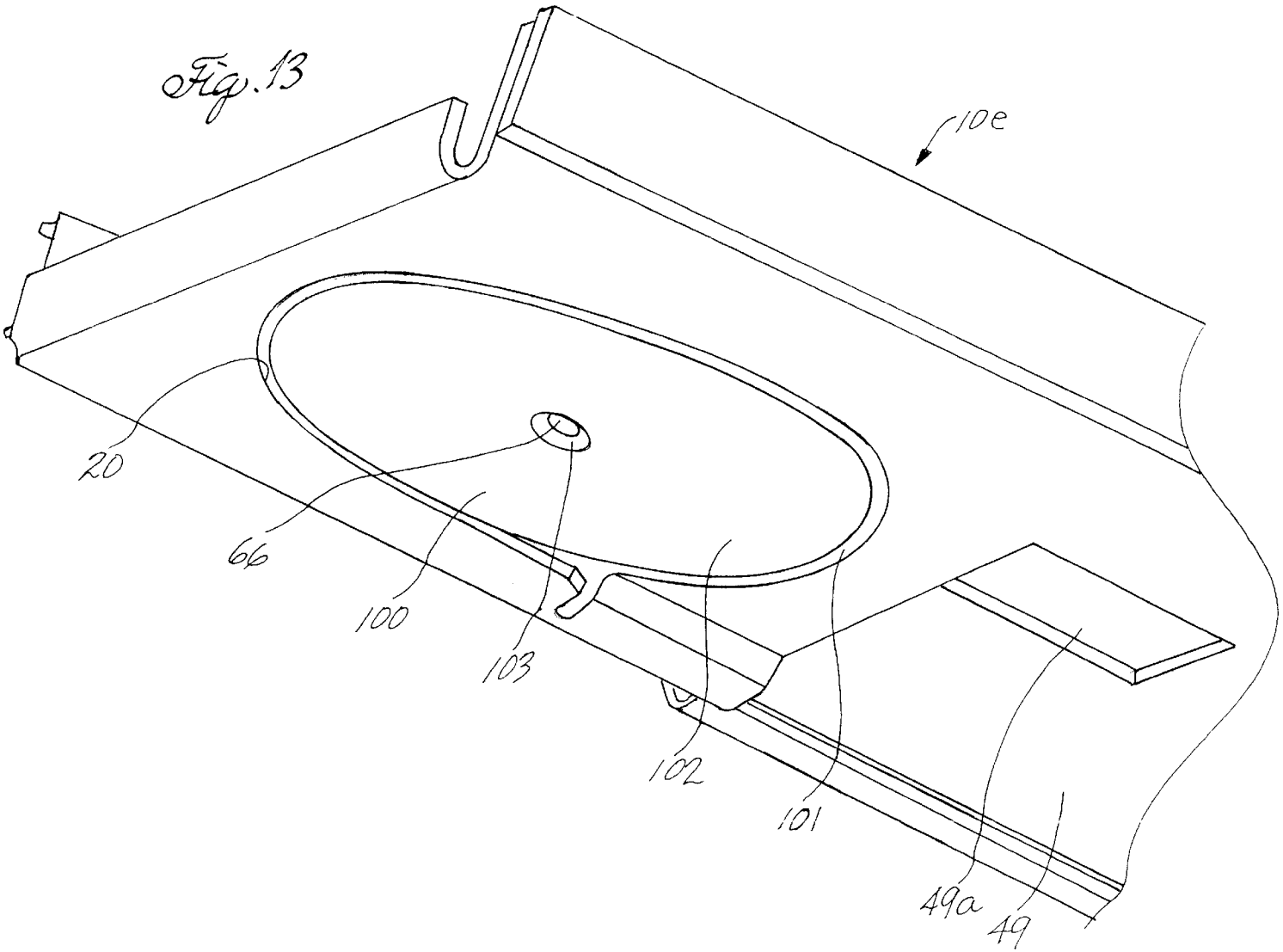
FIG. 13 is a perspective bottom view of an extendable swivel mounting bracket and a casing of FIG. 11.

The knob also has a plunger 62 with a first part 65 and a second part 66 which is substantially orthogonal to and extends from a midsection of the first part. Inside of the knob is a compression spring 63 which is coupled with the plunger and wrapped around the first part of the plunger. (See FIG. 12) The spring is in a compressed position when the second part of the plunger is seated in between the two extensions of the knob. The second part 66 extends through a hole or aperture 27*a* in an extending member 27" of the bridge, and through the central hole 103 in the disk plate 100. (See also FIG. 13) The second part thereby restricts motion of the disk plate in a direction perpendicular to the length of the second part, so that the disk plate will not unintentionally slide out from the mounting bracket 10*e*.

In order to remove the disk plate from the support surface (or alternatively slide the disk plate onto the support surface), the plunger is pulled by the user in a direction away from the disk plate. This pulling action tensions the spring and pulls the first part out of the hole 103. The disk plate is then enabled to be slid relative to the support surface as desired. Upon release of the tension force, the plunger retracts to the compressed position due to the spring. If the disk plate is in between the support surface and the bridge when the plunger retracts, the disk plate will be secured in place when the first pin drops into the corresponding hole.

In an alternative embodiment, the plunger has a plunger key part (not shown). The plunger key part locks the knob 60 to the object to be mounted, for example, a CPU unit, through the mounting bracket. When a key is inserted into the plunger key part and turned in an unlocking position, the plunger key unlocks, thereby allowing the plate to move from between the support surface and the bridge. Similarly, when the plate is inserted between the support surface and the bridge, and the key is turned in an opposite direction of the unlocking position, the plunger key part locks the plate.

The plunger key part couples with the plate to lock the plate. In one embodiment, the plunger key part has a pin that extends down from a main body of the plunger key part. The pin inserts into a central hole of the plate. The plunger key part is affixed to the bridge of the mounting bracket, so that the pin will not be removed from the central hole of the plate without use of the key. While inserting and turning the key into the unlocked position, the pin retracts back from the central hole to a position that allows the plate to slide out. When the key is turned in an opposite direction, the pin pushes out from the main body into the central hole, thereby locking the plate. Alternatively, the pin and/or the main body may have notches or threads that allow the plunger key part to couple with the plate to lock the plate between the support surface and the bridge.

Figure 14:
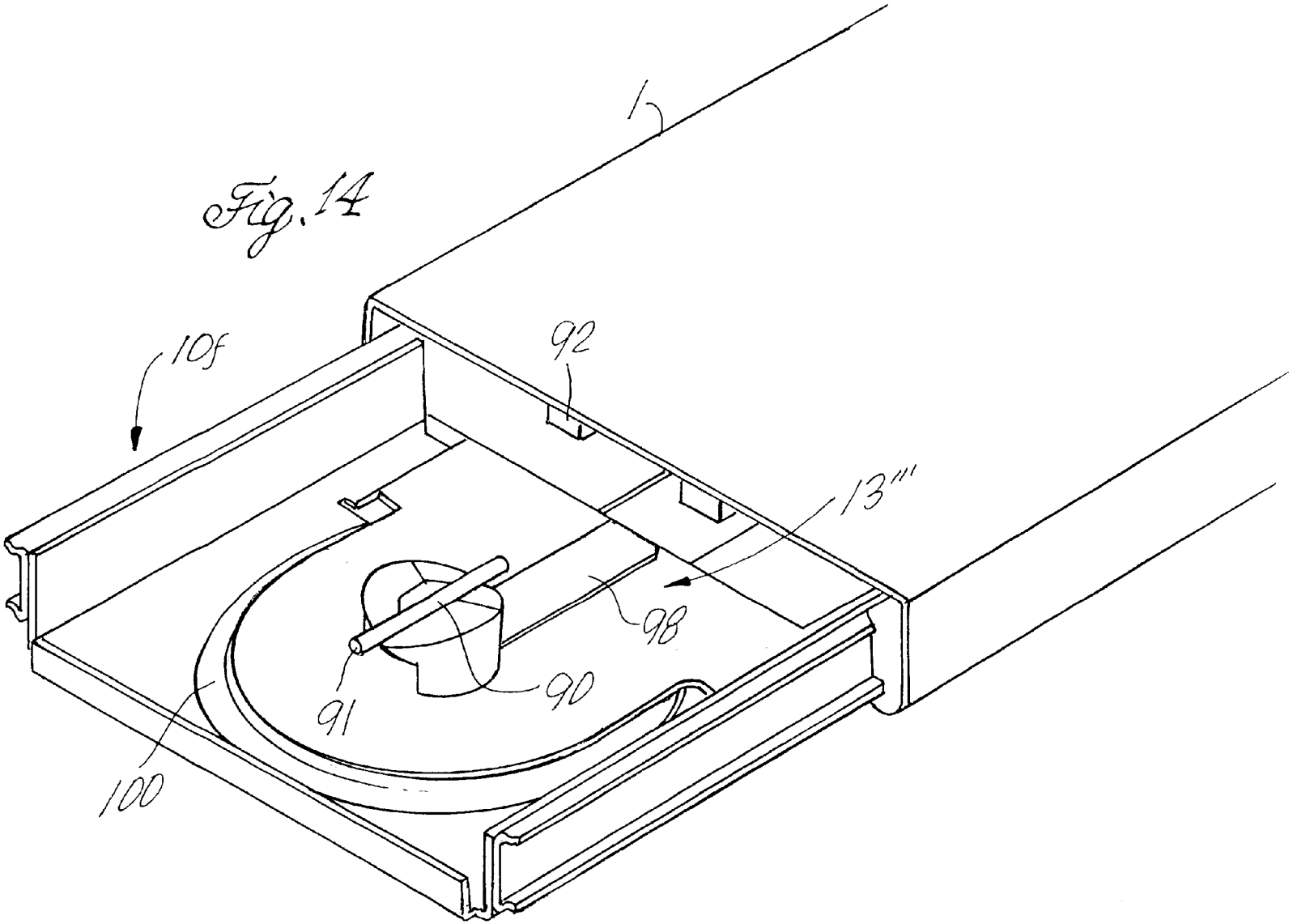
FIG. 14 is a perspective view of an extendable swivel mounting bracket and a casing according to a fifth embodiment of the present invention.

The embodiment of FIG. 14 is similar to the embodiment shown in FIG. 11. The main difference in FIG. 14 is that a leaf spring 98 is used to lock the plate in position rather than the compression spring. In a locked position, the leaf spring 98 is a long plate that lays flat on a bridge 13"' from a back edge to a center of the bridge where the plunger 90 is located. The leaf spring 98 is coupled at one end to an upper surface of a bridge 13"'. Another end of the leaf spring 98 is coupled to a handle 91 of the plunger 90. The handle 91 has an end (not shown) that is inserted into a hole (not shown) in the plate, through a hole (not shown) in the extending member, which locks the plate into the mounting bracket 10*f*. When the handle 91 is rotated and lifted, the handle end pulls out of the hole in the plate, thereby unlocking the plate. In an open position of the leaf spring, a forward end (not shown) of the leaf spring lifts when the handle 91 is twisted up. When the user releases the handle, the resiliency of the leaf spring pulls the handle back down, thereby forcing the end of the plunger back down through the hole of the extending member and the hole of the plate (if the plate is under the extending member).

Figure 16:
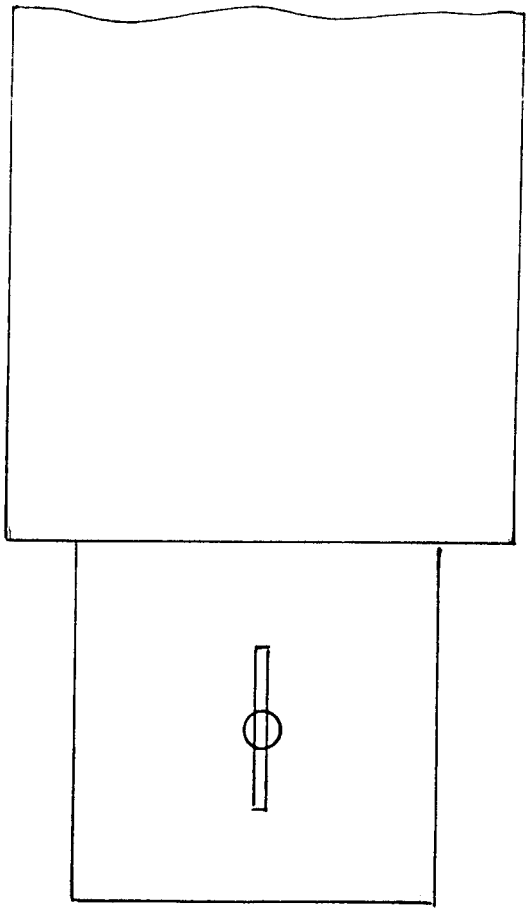
FIG. 16 is a top view of the plunger of FIG. 14 with the disk in the locked position.
Figure 15:
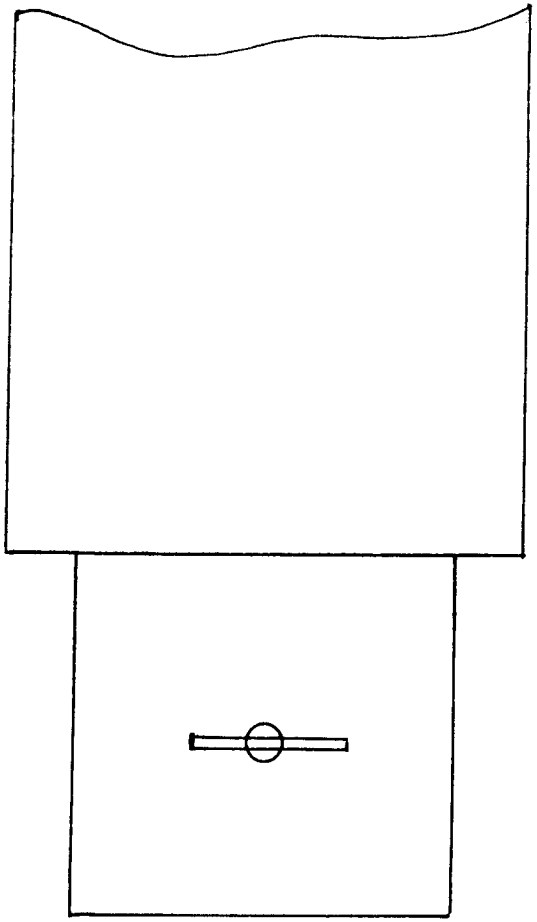
FIG. 15 is a top view of the plunger of FIG. 14 with the disk in the unlocked position.

The handle 91 of the plunger 90 of FIG. 14 has an unlocked position (FIG. 15) and a locked position (FIG. 16). In the unlocked position, the plate 100 can be removed from the mounting bracket 10*f* by sliding the plate toward the casing 1. In the locked position of the handle, the plate 100 is coupled to the plunger and can not translate out of the mounting bracket.

In the locked position of the handle, the longitudinal direction of the handle is parallel to the longitudinal direction of the casing. The stoppers 92 are positioned such that when the handle 91 is in the locked position, the handle slides between the stoppers and the mounting bracket slides into the casing.

Figure 18:
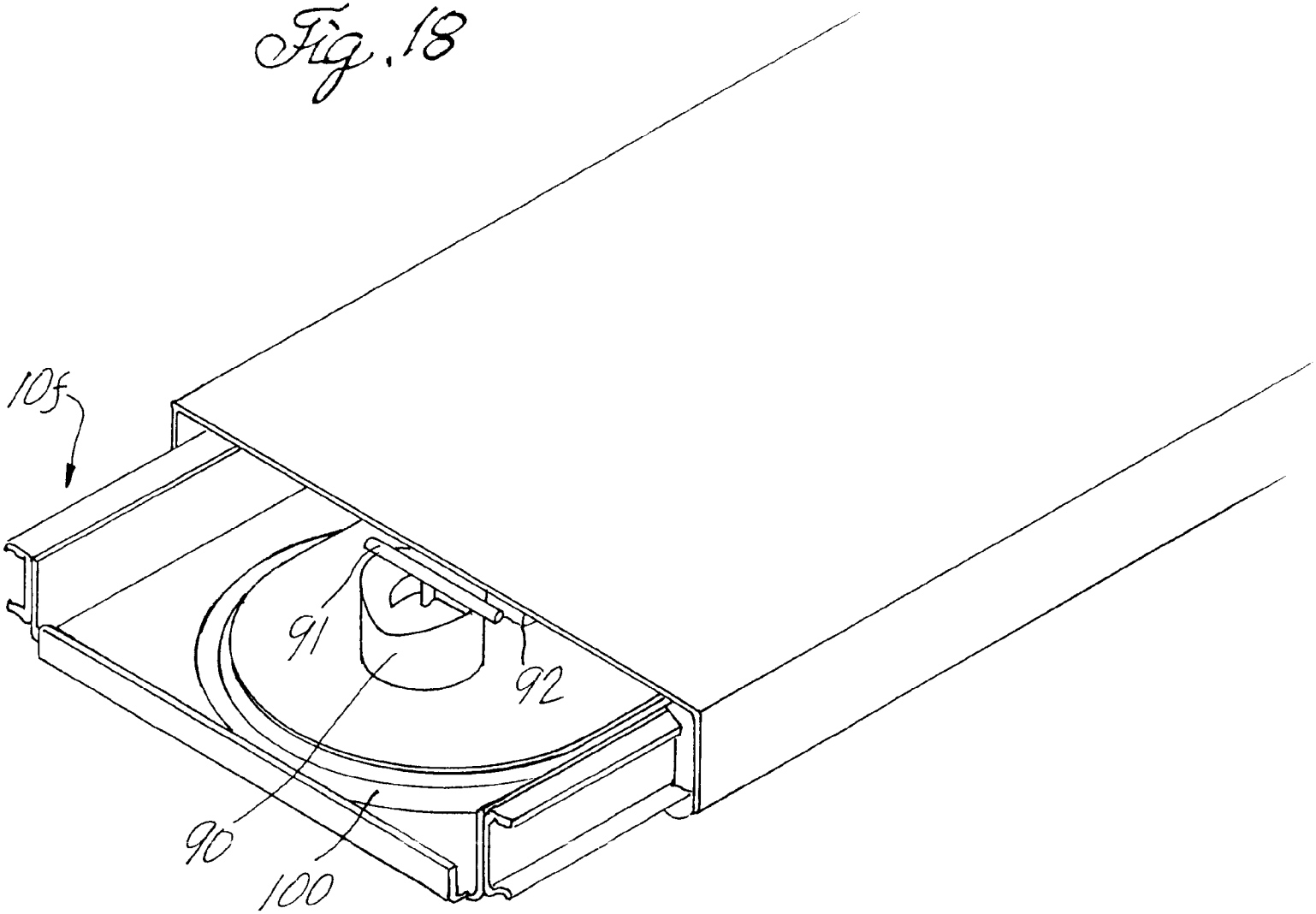
FIG. 18 is a perspective view of the plunger in the unlocked position and against the stoppers of FIG. 14.

In the unlocked position of the handle, the longitudinal direction of the handle is perpendicular to the longitudinal direction of the casing. Two stoppers 92 are provided on an undersurface of the casing 1 to block insertion of the mounting bracket into the casing when the handle is in the unlocked position. When the handle is in the unlocked position and the mounting bracket is slid into the casing, the handle contacts the stoppers. Upon contact of the handle with the stoppers, the mounting bracket is thereby prevented from further inserting into the casing as shown in FIG. 18.

Figure 17:
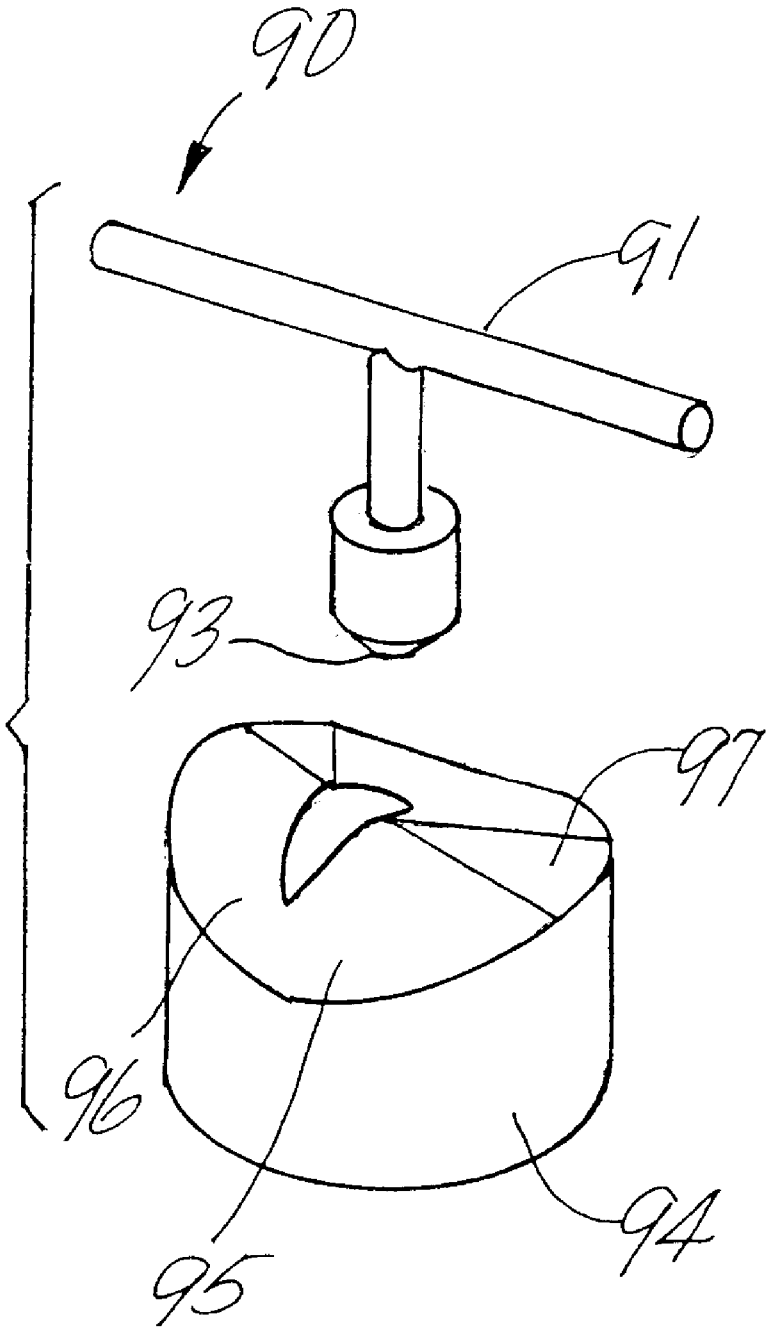
FIG. 17 is an exploded view of the plunger of FIG. 14.

FIG. 17 illustrates the plunger 90 of FIG. 14 in an exploded view. A chamfered bottom 93 of the handle 91 is coupled to a housing 94 of the plunger. The chamfered bottom 93 allows the plunger 90 to cam up when the plate is slid under the extending member. A detent feature 95 is provided on the housing 94 to prevent the handle 91 from accidentally being turned to a disconnected position. When the plunger 90 is to be disconnected from the plate, the handle turns 90 degrees and moves from the detent 95 up a cam surface 96 of the housing to another surface 97. In one embodiment, the surface 97 can be flat. In alternative embodiments not shown, the surface 97 can be a ridge that does not allow the handle 91 to seat, or a detent to keep the handle 91 from moving back down to detent 95. The leaf spring (not shown in FIG. 17) connects and moves with the handle 91 as described above to force the plunger back down along the cam surface 96 to the detent 95 in the locked position. Alternatively, the compression spring of the embodiment of FIG. 11 can be used to force the plunger down into the locked position. In a further alternative, the plunger may be pulled upwards against the force from the compression spring or the leaf spring to release the plate.

Figure 19B:
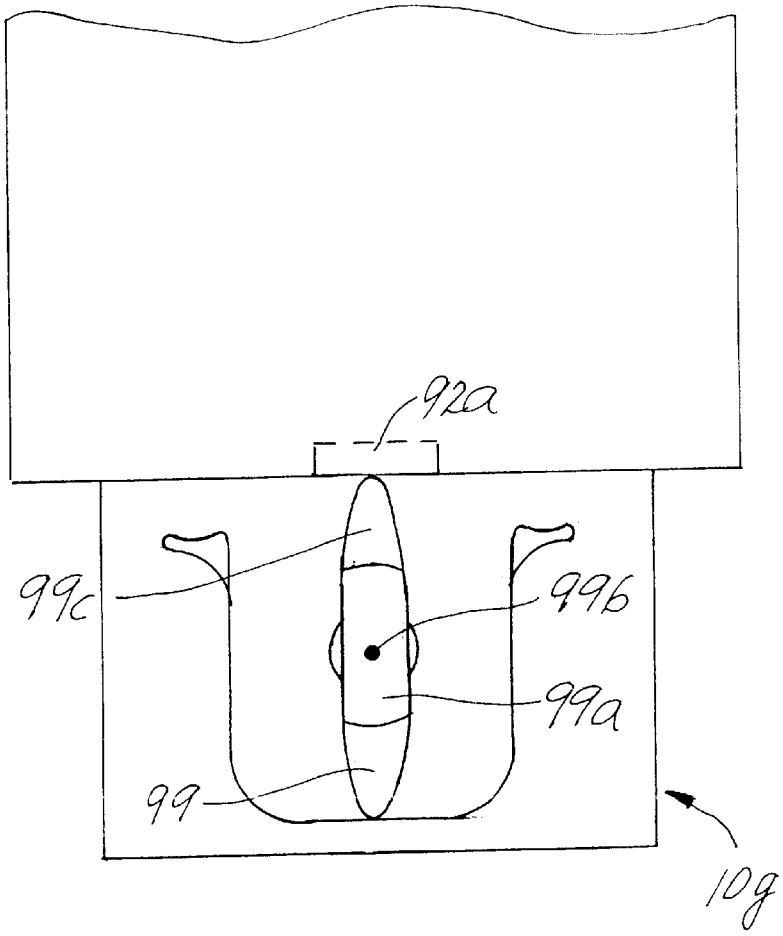
FIG. 19*b* is a top view of the alternative plunger of FIG. 19*a* with a handle in the unlocked position.
Figure 19A:
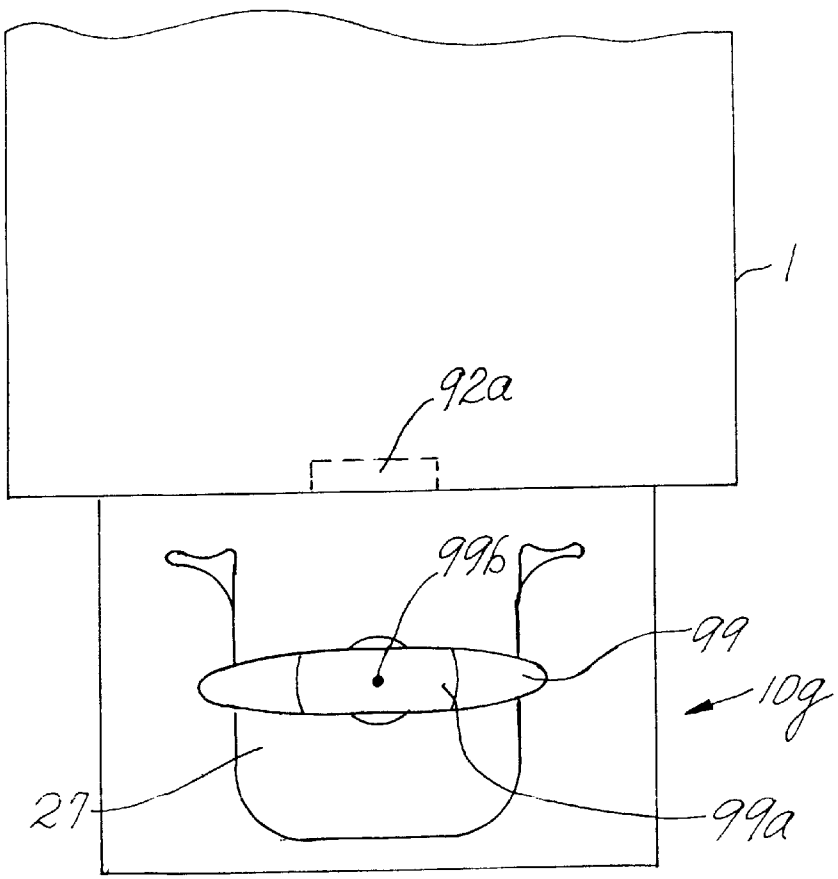
FIG. 19*a* is a top view of an alternative plunger with a handle in the locked position.

In yet another alternative to FIG. 17, shown in FIG. 19*a*, is a mounting bracket with a handle 99 that is used in place of the handle 91 of FIG. 17. In FIG. 19*a*, the handle 99 is shown in a position where the plate is locked. A pin 99*b* is coupled to the handle 99 and inserts into the plate through the extending member 27 to lock the plate. In FIG. 19*b*, the handle 99 is shown in a position 90 degrees to the position of FIG. 19*a*. In FIG. 19*b*, the plate is in an unlocked position. The handle 99 is both lifted and turned to this unlocked position. As the handle 99 lifts, the pin 99*b* lifts out of the plate, thereby unlocking the plate.

A stopper 92*a* is provided on an underside of the entrance to the casing 1. The location of the stopper 92*a* is shown in dashed lines. The stopper 92*a* acts to stop the mounting bracket from inserting into the casing, when the plate is unlocked from the mounting bracket 10*g*. The handle 99 in FIG. 19*a* is able to slide underneath the stopper 92*a* because the center of the handle, or optionally, an indent 99*a*, is at a plane lower than the bottom of the stopper 92*a*. However, when the handle 99 is rotated 90 degrees as shown in FIG. 19*b*, because the handle is lifted, one of an end 99*c* comes into contact with the stopper 92*a*. As a result, the mounting bracket is thereby not permitted to move into the casing 1. This provides the advantage of having the mounting bracket in a nonmovable position when unlocked, so that the user will be notified to lock the plate before the mounting bracket is placed into the casing.

Figure 20:
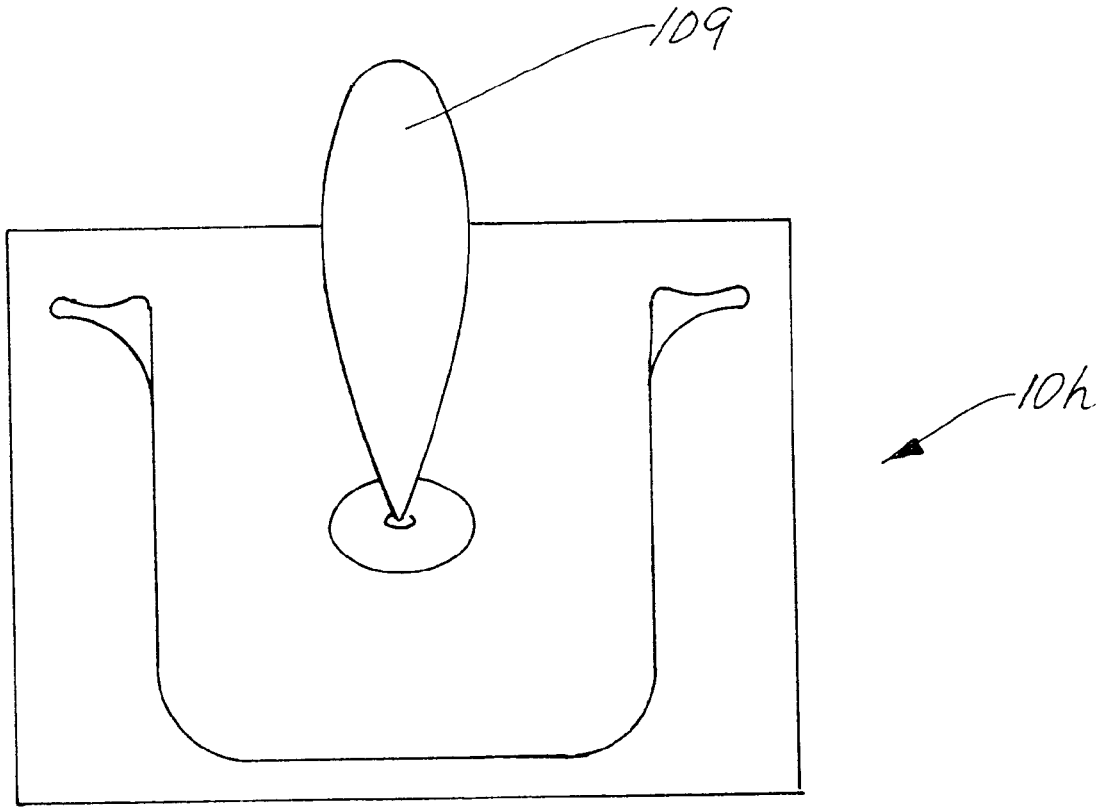
FIG. 20 is a top view of a plunger in an alternative embodiment.

FIG. 20 depicts another embodiment similar to the embodiment of FIG. 19*a*, where a handle 109 is provided. Access to twisting the handle 109 is provided through the bottom of the casing at the rear of the mounting bracket 10*h*. When the handle 109 is twisted, similar to FIG. 19*a*, the handle moves from a locked position with the plate to an unlocked position.

The plate can be slid in from the front of the mounting bracket or from either side thereof. However, it has been discovered that if the plate is slid in from the back of the mounting bracket, a more stable design results. The reason for this is that when the mounted object is fully extended from the front of the mounting bracket, a cantilever load results and a front part of the mounting bracket is needed to support severe downward loads. The cantilever load creates an eccentric support requirement in the bracket. The bridge supports rear upward loads, but the front part is needed to support the loads placed on the mounted objects. If the plate were to slide in the front of the mounting bracket, then there would be no front wall to keep the plate from sliding back out of the bracket upon extreme loads.

Figure 21:
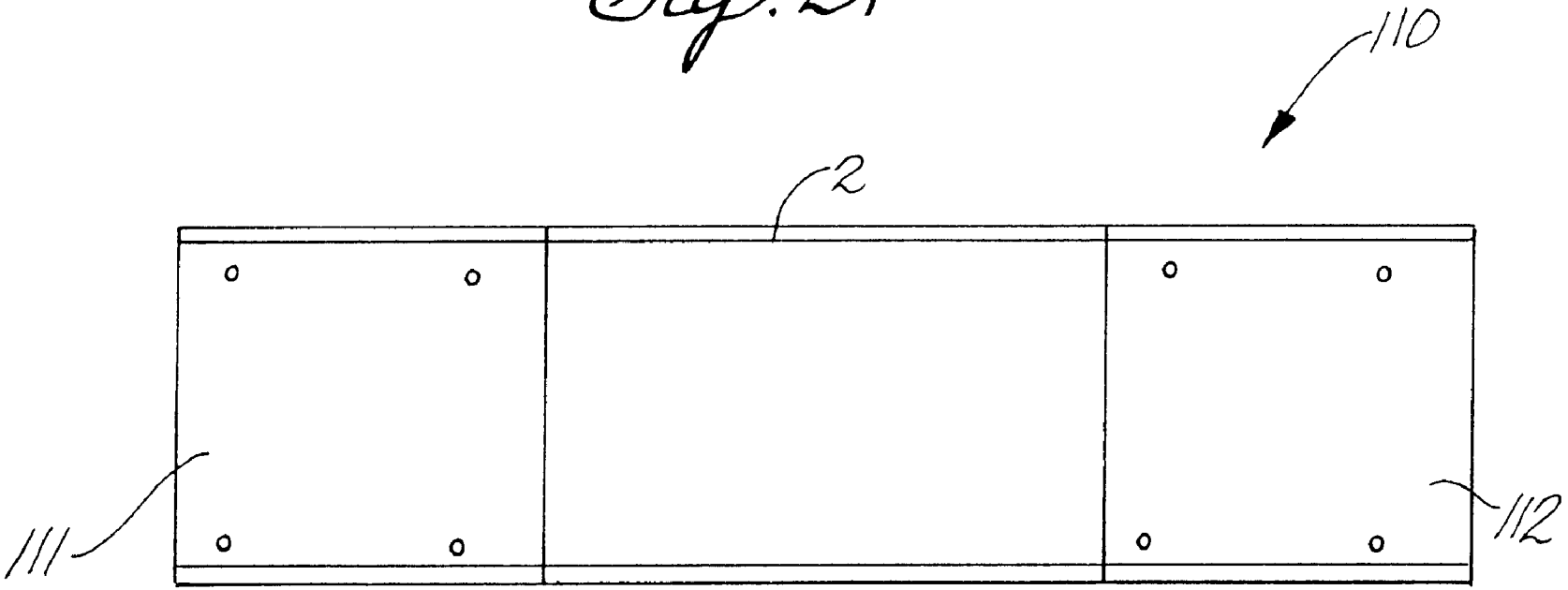
FIG. 21 is a top view of the two part casing.

A preferred embodiment of the casing is illustrated in FIG. 21. A two part casing 110 replaces the longer casing 1. A front casing 111 and a back casing 112 of the two part casing 110 are mounted separately to the undersurface. Slide members 2 are then mounted to both front and back casings 111, 112. The advantage of this design is that different sizes and lengths of slide members can be used with the two part casing 110. The user adjusts the front and back casing 111, 112 depending on the length of slide member required. Different size slide members will be used depending on the object to be mounted, but only one casing for each object is needed.

Although this invention has been described in certain specific embodiment, many additional modifications and variations will be apparent to those skilled in the art. It is therefore to be understood that this invention may be practiced otherwise and as specifically described. For example, the device used with the extendable swivel mounting bracket in the present invention need not be a computer keyboard support arm. Any slide accessory which can also be adapted to swivel, such as for a holder adapted for a CPU unit, may incorporate the present invention. Thus, the present embodiments of the invention should be considered in all respects as illustrated and not restrictive, the scope of the invention to be indicated by the appended claims rather than the foregoing description.

What is claimed is:

1. A mounting bracket for mounting an object to an undersurface comprising:

a support surface having an opening;

a plate rotatably supported around the opening by the support surface, the plate adapted to be coupled to a mounted item on a portion of the plate about the opening, the support surface preventing motion of the plate in a first direction;

a holding surface coupled to the support surface, the holding surface preventing motion of the plate in a direction opposite the first direction, the support surface and the holding surface forming a slidable recess adapted to receive the plate between the support surface and the holding surface, and wherein the holding surface comprises a bridge coupled to the support surface, the bridge forming a band preventing motion of the plate in the direction opposite the first direction.

2. The mounting bracket for mounting an object to an undersurface of claim 1 wherein the support surface comprises a surface with an opening along one side of the surface.

3. The mounting bracket for mounting an object to an undersurface of claim 2 wherein the opening is incurvate.

4. The mounting bracket for mounting an object to an undersurface of claim 3 wherein the bridge extends over a portion of the opening.

5. The mounting bracket for mounting an object to an undersurface of claim 4 wherein the plate is circular.

6. The mounting bracket for mounting an object to an undersurface of claim 5 where in the plate is rotatable about its center.

7. The mounting bracket for mounting an object to an undersurface of claim 6 wherein the bridge includes a portion over the center of the plate.

8. The mounting bracket for mounting an object to an undersurface of claim 7 wherein the plate has a mounting hole, the mounting hole being adapted to mount an object to the plate.

9. The mounting bracket for mounting an object to an undersurface of claim 6 further comprising means for retaining the plate between the support surface and the holding surface.

10. The mounting bracket for mounting an object to an undersurface of claim 9 wherein the means for retaining the plate comprises a locking lever coupled to the bridge, the locking lever extending beyond the plate and having a bend that restricts motion of the plate.

11. The mounting bracket for mounting an object to an undersurface of claim 10 wherein the locking lever is displaceable so as to allow the plate to move from between the support surface and the holding surface.

12. The mounting bracket for mounting an object to an undersurface of claim 9 wherein the means comprises a tab extending from the bridge.

13. The mounting bracket for mounting an object to an undersurface of claim 6 wherein the plate includes a plate aperture at its center and the bridge includes a bridge aperture in the portion over the center of the plate.

14. The mounting bracket for mounting an object to an undersurface of claim 13 further comprising a post inserted in the plate aperture and the bridge aperture.

15. The mounting bracket for mounting an object to an undersurface of claim 14 further comprising a spring coupled to the post, the spring biasing the post to remain in the plate aperture and the bridge aperture in a normally locked position.

16. The mounting bracket for mounting an object to an undersurface of claim 15 wherein the post comprises a handle that one of rotates or pulls to a position where the plate can be moved.

17. The mounting bracket for mounting an object to an undersurface of claim 16 further comprising a housing with a chamfered edge and a detent, wherein the handle is held in a locked position in the detent.

18. A mounting bracket for mounting an object to an undersurface comprising:

a support surface having an opening;

a plate rotatably supported around the opening by the support surface, the plate adapted to be coupled to a mounted item on a portion of the plate about the opening, the support surface preventing motion of the plate in a first direction;

a holding surface coupled to the support surface the holding surface preventing motion of the plate in a direction opposite the first direction, the support surface and the holding surface forming a slidable recess adapted to receive the plate between the support surface and the holding surface, and wherein the mounting bracket comprises a front and a back, and the plate is capable of sliding out from the back upon release.

19. An extendable mount for mounting an object to an undersurface comprising:

a support surface having an opening;

a plate rotatably supported around the opening by the support surface, the plate adapted to be coupled to a mounted item on a position of the plate about the opening the support surface preventing motion of the plate in a first direction;

a holding surface coupled to the support surface, the holding surface preventing motion of the plate in a direction opposite the first direction, the support surface and the holding surface forming a slidable recess adapted to receive the plate between the support surface and the holding surface; and a casing coupled to the support surface by at least one slide.

20. The extendable mount for mounting an object to an undersurface of claim 19 wherein the casing comprises a rectangular surface having opposing sides descending therefrom.

21. The extendable mount for mounting an object to an undersurface of claim 20 wherein a slide is coupled to each of the opposing sides of the casing.

22. The extendable mount for mounting an object to an undersurface of claim 21 further comprising opposing side walls coupled to the support surface, the slides couple the casing and the support surface through the opposing sides of the casing and the opposing side walls.

23. The extendable mount for mounting an object to an undersurface of claim 19 wherein the holding surface comprises a bridge coupled to the support surface, the bridge forming a band preventing motion of the plate in the direction opposite the first direction.

24. The extendable mount for mounting an object to an undersurface of claim 23 wherein the support surface comprises a surface with an opening along one side of the surface.

25. The extendable mount for mounting an object to an undersurface of claim 24 wherein the opening is incurvate.

26. The extendable mount for mounting an object to an undersurface of claim 25 wherein the bridge extends over a portion of the opening.

27. The extendable mount for mounting an object to an undersurface of claim 26 wherein the plate is circular.

28. The extendable mount for mounting an object to an undersurface of claim 27 wherein the plate is rotatable about its center.

29. The extendable mount for mounting an object to an undersurface of claim 28 wherein the bridge includes a portion over the center of the plate.

30. The extendable mount for mounting an object to an undersurface of claim 29 wherein the plate has a mounting hole, the mounting hole being adapted to mount an object to the plate.

31. The extendable mount for mounting an object to an undersurface of claim 28 further comprising means for retaining the plate between the support surface and the holding surface.

32. The extendable mount for mounting an object to an undersurface of claim 31 wherein the means for retaining the plate comprises a locking lever coupled to the bridge, the locking lever extending beyond the plate and having a bend that restricts motion of the plate.

33. The extendable mount for mounting an object to an undersurface of claim 32 wherein the locking lever is displaceable so as to allow the plate to move from between the support surface and the holding surface.

34. The extendable mount for mounting an object to an undersurface of claim 31 wherein the means comprises a tab extending from the bridge.

35. The extendable mount for mounting an object to an undersurface of claim 28 wherein the plate includes a plate aperture at its center and the bridge includes a bridge aperture in the portion over the center of the plate.

36. The extendable mount for mounting an object to an undersurface of claim 35 further comprising a post inserted in the plate aperture and the bridge aperture.

37. The extendable mount for mounting an object to an undersurface of claim 36 further comprising a spring coupled to the post, the spring biasing the post to remain in the plate aperture and the bridge aperture in a normally locked position.

38. The extendable mount for mounting an object to an undersurface of claim 37 wherein the post comprises a handle that one of rotates or pulls to a position where the plate can be moved.

39. The extendable mount for mounting an object to an undersurface of claim 38 further comprising a housing with a chamfered edge and a detent, wherein the handle is held in a locked position in the detent.

40. The extendable mount for mounting an object to an undersurface of claim 19 wherein the extendable mount comprises a front and a back, and the plate is capable of sliding out from the back upon release.

* * * * *